United States Patent [19]

Nickles

[11] 4,272,841

[45] Jun. 9, 1981

[54] TIMEPIECE

[75] Inventor: Francois Nickles, Cornaux, Switzerland

[73] Assignee: Ebauches Electroniques SA, Marin, Switzerland

[21] Appl. No.: 81,165

[22] Filed: Oct. 2, 1979

Related U.S. Application Data

[63] Continuation of Ser. No. 841,564, Oct. 12, 1977, abandoned.

[30] Foreign Application Priority Data

Oct. 22, 1976 [CH] Switzerland ..... 13358

[51] Int. Cl.[3] ..... G04B 19/00; G04G 5/00; G04G 9/02

[52] U.S. Cl. ..... 368/224; 368/69; 368/88; 368/185

[58] Field of Search ..... 368/29, 30, 62, 82–84, 368/69, 170, 88, 187, 188, 223, 224

[56] References Cited

U.S. PATENT DOCUMENTS

| | | | |
|---|---|---|---|
| 4,033,110 | 7/1977 | Sagarino | 368/159 |
| 4,051,665 | 10/1977 | Arn | 368/69 |
| 4,095,405 | 6/1978 | Tamaka | 368/34 |
| 4,095,412 | 6/1978 | Burke | 368/88 |

*Primary Examiner*—Edith S. Jackmon
*Attorney, Agent, or Firm*—Imirie & Smiley

[57] ABSTRACT

An electronic module for a timepiece and comprises a display cell and an electric control circuit including contact means for operation by at least one push-button. The contact means includes at least one contact and release spring in order to close a control circuit by acting on a circuit board forming part of said circuit. The contact spring is constituted by a single piece of a metallic frame of the display cell, the spring a cut-out of such frame which is electrically connected to one pole of a source of electrical energy.

14 Claims, 6 Drawing Figures

TIMEPIECE

This is a continuation of application Ser. No. 841,564, filed Oct. 12, 1977 which is now abandoned.

BACKGROUND OF THE INVENTION

The present invention relates to a timepiece provided with an electronic module comprising a display cell and at least one push-button cooperating with at least one contact and release spring in order to close a control circuit by acting on a printed circuit board.

Electronic watches of this kind are generally provided with push-buttons distributed on the periphery of the watch case. Such push-buttons are capable of making a correction of the indications of the watch, to change the display mode or to control the illumination of the display. The switches of known watches are provided with pieces which are mounted on the module and are intended to form an electrical contact, but this leads to a relatively complicated solution.

In other known systems, the push-buttons which are at least partly metallic form an operative conductive part of a switch. However, for such a solution, a watch case, made of an electrically conducting material, is required in order to obtain a closed electrical circuit through the case and one of the push-buttons.

SUMMARY OF THE INVENTION

The present invention resides in an electronic module for a timepiece and having a particularly simple system of contacts for operation by push-buttons. The module according to the invention is provided with a contact spring which is made from a single piece of a metallic frame of the display cell by cutting it out of the metallic frame, said metallic frame being electrically connected to one pole of the force of electrical energy.

In this manner, the control system does not require any additional part. Due to the fact that the push-button(s) act on the contact springs which are electrically connected to one of the poles of the source of electrical energy, it is not necessary to have a case made from a conductive material. It is possible to actuate the contact(s) without a watch case and without push-button(s) directly on the module, before mounting in the case. It is also possible to make a multiple-contact switch. More particularly, one has a great freedom of the choice of the position of the push-buttons angularly as well as in the width of the timepiece. It is only necessary to provide sufficiently large contact areas at the ends of the contact springs.

Preferably, the contact and release spring cooperates with at least one metallized part deposited on at least one portion of the edge of the printed circuit board of the module. In this embodiment it is important that the push-button(s) do/does not engage directly the metallization of the printed circuit board, this metallization being critical.

BRIEF DESCRIPTION OF THE DRAWING

The present invention will be described further, by way of example, with reference to the accompanying drawings in which.

DESCRIPTION OF THE PREFERRED EMBODIMENT

Figure 1:
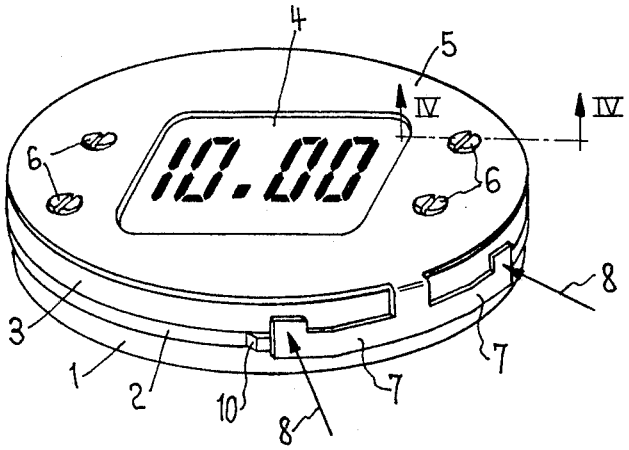
FIG. 1 is a general perspective view of a module according to the present invention.

The module represented in FIG. 1 is provided with a metal plate 1 comprising four pitched pins 11 comprising internally threaded sleeve portions (see FIG. 4) on which a printed circuit board 2 is mounted, the edge of which being seen in FIG. 1, a plastic or insulated frame 3 of a clockwork movement and the display cell 4 with its connectors which are oriented by the frame 3 and pressed against the printed circuit board by means of a metallic frame 5 of the display cell. The frame 5 is electrically grounded through four locking screws 6, the pitched pins 11 having internally threaded sleeve or socket portions 11' in which they are screwed and the plate 1.

Contact springs 7, obtained by bending of extensions of the frame 5 of the cell, are disposed along or around the module and in a direction parallel to it. The contact springs 7 are thus made from a single piece of the metallic frame 5 of the display cell by cutting them integrally from the frame. FIG. 1 shows an embodiment with two push-buttons. These push-buttons are mounted in a well known manner in the watch case (not shown) and they are capable of exerting a pressure on the free ends of the contact springs 7 in the direction indicated by the arrows 8 in FIG. 1, said arrows representing push buttons.

Figure 2:
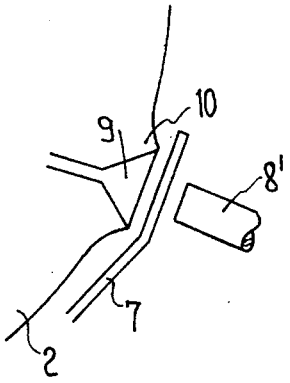
FIG. 2 is a fragmentary cross-sectional diagrammatic view of a detail of the embodiment according to FIG. 1.

FIG. 2 shows part of the printed circuit board. The push-button 8' is capable of pressing the ends of the contact springs 7 against the metallized part or parts 9 deposited on the slightly salient portions 10 of the printed circuit board 2.

When one depresses one of the push-buttons 8', the free end of the contact spring 7 is pressed against at least one metallized part 9 at the edge of the printed circuit board. In this manner, a closed control circuit is formed from one of the poles of the source of electrical energy through the plate 1, the pitched pins 11, the metallic frame 5, the depressed contact spring 7 and the metallized part 9.

Figure 3:
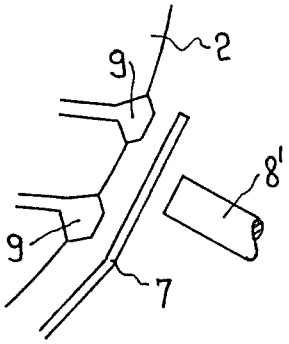
FIG. 3 is a fragmentary cross-sectional diagrammatic view of a detail of a second embodiment of the invention.

By metallizing two or more parts of the edge of the printed circuit board, it is possible to make a double or multiple contact switch. FIG. 3 represents an embodiment where the end of the contact spring 7, capable of being actuated by the push-button 8', acts on two metallized parts deposited on the edge of the printed circuit board 2.

Figure 4:
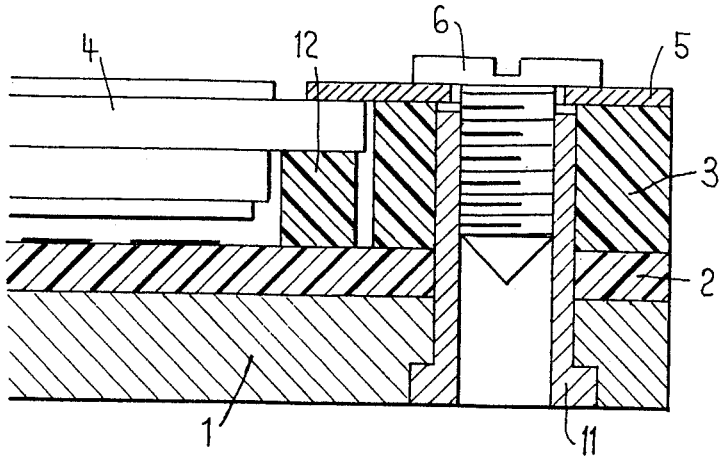
FIG. 4 is a fragmentary cross sectional of the module taken on line IV—IV of FIG. 1.

It is obvious that several contact springs such as represented in the FIG. 1 can be provided on the periphery of the module. The contact springs 7 may also function as release springs for the push-buttons 8'. FIG. 4 shows a cross section of the module as an illustration of its internal construction. It is clearly visible how through the metallic frame 5 the connectors 12 of the display cell 4 are pressed against the printed circuit board 2 in order to establish the electrical connection between the display cell and the printed circuit. It is also to be seen that the locking screws 6 which are screwed in the pitched pins 11 hold the components of the module together.

Figure 5:
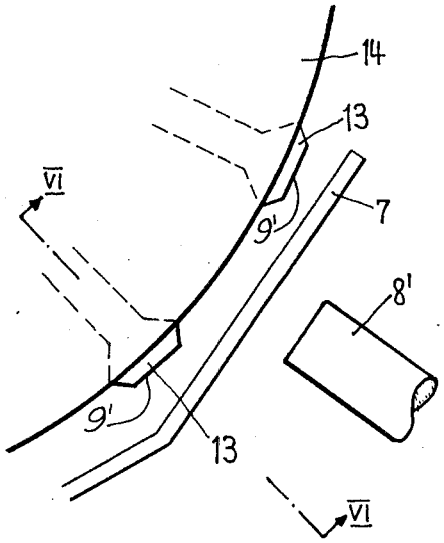
FIG. 5 is a fragmentary, cross-sectional diagrammatic view of a detail of a third embodiment of the invention
Figure 6:
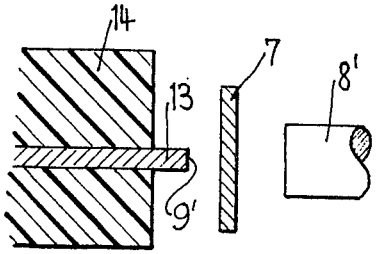
FIG. 6 is a cross section along the line VI—VI of FIG. 5.

The circuit board may comprise a printed circuit, as hereinbefore described, or it may be constituted by a metal grating. FIGS. 5 and 6 diagrammatically show the circuit board in the form of a metal grating 13 sealed in a plastic molding 14 of the clockwork movement. A contact spring 7 cooperates with metalized parts 9' of the metal grating.

I claim:

1. An electronic module for assemblege with a timepiece that carries a push button, said module comprising a metallic frame; a display cell mounted to said metallic frame in electrical communication therewith; and a circuit board in electrical communication with said display cell and mounted to said metallic frame but insulated therefrom, said circuit board having at least one contact, said metallic frame being electrically connected to a source of electric energy and having metallic spring means normally spaced from but cooperative with said contact and adapted to constitute a switch upon translational movement of said spring means by the push button, said spring means serving as a return spring for such push button and being integral with and formed of portions of said metallic frame to provide a compact, self contained electronic module structure.

2. A module according to claim 1 wherein said contact is disposed on the edge of said circuit board.

3. A module according to claim 2 wherein said contact protrudes from the edge of said circuit board and said spring means is spaced from and in line with said contact.

4. A module according to claim 2 wherein said spring means of said metal frame comprise at least one contact blade extending from and disposed along the module and in a parallel direction thereto, said contact blade being bent over the edge of said module.

5. An electronic module for a timepiece, comprising an electric circuit including a display cell; a circuit board in electric communication with said display cell and having at least one contact; a metallic frame electrically connected to said display cell and for connection to a source of electric energy; a metal plate; and pitched pins connecting said plate with said metallic frame, said metallic frame having spring contact means normally spaced from but cooperative with said contact and adapted to constitute a switch upon movement of said spring means by a push button carried by a timepiece with which the module may be assembled, said spring means serving as a return spring for such push button and being integral with and formed of portions of said metallic frame to provide a compact, self-contained electronic module structure.

6. A module according to claim 5 wherein said circuit board comprises a printed circuit.

7. A module according to claim 5 wherein said circuit board comprises a metal grating.

8. A module according to claim 5 wherein said circuit is disposed on the edge of said circuit board.

9. A module according to claim 8, wherein said contact protrudes from the edge of said circuit board.

10. A module according to claim 9 wherein said spring contact means is spaced from and in line with said contact.

11. A module according to claim 5 wherein said metallic frame is electrically connected to ground by means of said pitched pins which are in communication with said metal plate, said pins having internally threaded sleeves, and screws.

12. A module according to claim 11 comprises a stack including said metal plate, said circuit board, said display cell, connectors between portions of said cell and said circuit board, an insulating frame engaging said circuit board in surrounding relation to said cell and connectors, said metallic frame overlying said insulating frame and portions of said cell said metal plate, circuit board and insulating frame having aligned bores therein and receiving said pitched pins which have a length no greater than the combined thickness of said plate, board and frame, one end of said pins being electrically connected to said plate and the other end including said internally threaded sleeve, and said metallic frame having holes axially aligned with said bores and receiving said screws.

13. Module according to claim 12 wherein said spring contact means of said metal frame comprise at least one contact blade extending from and disposed along the module and in a parallel direction thereto, said contact blade being bent over the edge of said module.

14. Module according to claim 5, wherein said circuit board is provided with a plurality of electrically conductive paths each having a contact cooperating with a respective spring contact means of said metallic frame, said spring contact means being capable of individual actuation.

* * * * *